United States Patent [19]

Lewis

[11] Patent Number: 4,884,746

[45] Date of Patent: Dec. 5, 1989

[54] FUEL NOZZLE AND IMPROVED SYSTEM AND METHOD FOR INJECTING FUEL INTO A GAS TURBINE ENGINE

[75] Inventor: George D. Lewis, Kodak, Tenn.

[73] Assignee: Radial Turbine International A/S, Kongsberg, Norway

[21] Appl. No.: 11,312

[22] Filed: Feb. 5, 1987

[51] Int. Cl.[4] ..... B05B 7/10

[52] U.S. Cl. ..... 239/5; 239/8; 239/400; 239/402; 239/404; 239/406

[58] Field of Search ..... 239/5, 8, 11, 400, 402, 239/404, 405, 406, 416.4, 416.5

[56] References Cited

U.S. PATENT DOCUMENTS

| | | | |
|---|---|---|---|
| 1,069,243 | 8/1913 | Fogler | 239/405 |
| 1,381,095 | 6/1921 | Starr | 239/400 |
| 1,462,395 | 7/1923 | Thompson | 239/404 |
| 1,567,482 | 12/1925 | Anthony | 239/404 |
| 1,740,296 | 12/1929 | Gerdes et al. | 239/406 |
| 1,934,837 | 11/1933 | Zulver | 239/400 |
| 3,853,273 | 12/1974 | Bahr et al. | 239/406 |
| 4,198,815 | 4/1980 | Bobo et al. | 239/406 |
| 4,559,009 | 12/1985 | Marino et al. | 239/404 |

FOREIGN PATENT DOCUMENTS

| | | | |
|---|---|---|---|
| 805006 | 2/1981 | U.S.S.R. | 239/404 |

*Primary Examiner*—Andres Kashnikow

*Assistant Examiner*—Michael J. Forman

*Attorney, Agent, or Firm*—Finnegan, Henderson, Farabow, Garrett & Dunner

[57] ABSTRACT

A fuel nozzle having two concentric flow paths, the interior flow path comprising a first swirl chamber having a first diameter, an exit chamber having a second diameter selected to be smaller than the first diameter, and a convergent section joining the first swirl chamber and the exit chamber. The exterior flow path comprises an annular second swirl chamber formed about the periphery of the exit chamber. The interior flow path has a fuel and air mixture flowing therethrough while the exterior flow path has air only flowing therethrough. Fuel in the interior flow path is caused to lie in a film and flow circumferentially about the internal wall of the first swirl chamber by air entering into the first swirl chamber through inlet holes which are configured to direct the air tangentially along the internal wall surface of the first swirl chamber. As the fuel film moves axially through the convergent section and into the exit chamber, the tangential velocity increases due to the smaller diameter of the exit chamber. Air in the annular second swirl chamber is directed into close association with the air and fuel leaving the exit chamber and the increased tangential velocity of the fuel film enhances the shearing effect of the air from the second swirl chamber on the fuel film to thereby break-up the fuel film into fine droplets at low fuel flow rates.

10 Claims, 4 Drawing Sheets

FUEL NOZZLE AND IMPROVED SYSTEM AND METHOD FOR INJECTING FUEL INTO A GAS TURBINE ENGINE

BACKGROUND OF THE INVENTION

1. Field of the Invention

The present invention relates to fuel nozzles, and more particularly to air-blast type fuel nozzles for gas turbine engines.

2. Description of the Related Art

Since the efficiency of a gas turbine engine increases as the pressure ratio increases, it is desirable to operate at as high a pressure ratio as feasible. State-of-the-art gas turbine engines operate at pressure ratios much higher than gas turbine engines of the past. One of the factors limiting the pressure ratio at which gas turbines operate are the physical properties of the materials which are used in making the engine components. Recent advances in materials science and engineering have provided materials for compressor and turbine blades and housings which can withstand the extremely high temperatures and pressures commensurate with the high pressure ratios at which state-of-the-art gas turbines operate.

The fuel flow rate to a gas turbine engine increases as the pressure ratio at which the engine operates increases. In like manner, the range of fuel flow rates from starting to full load power of the engine increases as the pressure ratio at which the engine operates increases. The pressure drop across a fuel nozzle for a gas turbine engine is proportional to the square of the fuel flow rate through the nozzle. Hence, at the higher fuel flow rates required for high pressure ratio engines, the pressure drop across the fuel nozzle becomes exceptionally high, for some engines as high as 2,500–3,000 p.s.i., with resulting increases in the complexity and cost of manufacture of the fuel nozzles to withstand the high pressure differentials.

One method of limiting the pressure drop across the fuel nozzle in high pressure ratio gas turbine engines is to minimize the fuel flow through the nozzle during start-up of the engine, thus limiting the upper end of the fuel flow range. Gas turbine engines commonly employ air-blast type fuel nozzles which utilize the pressure differential across the fuel inlet port of the fuel nozzle to atomize the fuel. Thus, at low fuel flow rates, and corresponding low pressure differentials across the nozzle, air-blast type fuel nozzles exhibit a diminished capacity to provide uniform sprays having fine particle sizes. Furthermore, air-blast type fuel nozzles are normally constructed of three concentric passages wherein air flows through the innermost passage, fuel flows through the intermediate passage, and air flows through the outermost passage. The separate air and fuel flows are mixed upon exiting from the nozzle. This three concentric passage configuration results in increased cost and complexity of manufacture of the nozzles.

It is an object of the present invention to provide a fuel nozzle for a gas turbine engine which provides fine droplet sizes in the fuel spray exiting therefrom at relatively low fuel flow rates and corresponding low pressure drops across the nozzle.

It is a further object of the invention to provide a method which utilizes kinetic energy in an air flow stream in the nozzle in combination with the pressure drop across the nozzle to break up fuel exiting from the nozzle into fine droplet sizes, at relatively low fuel flow rates.

It is a further object of the invention to provide a system for controlling the fuel spray angle exiting from a fuel nozzle by regulating the air flow rates through selected passages of the nozzle.

It is a further object of the invention to provide an air-blast type fuel nozzle for a gas turbine engine which is less complex and less costly to manufacture than prior art air blast type fuel nozzles.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purposes of the invention as embodied and broadly described herein, an air-blast type fuel nozzle for a gas turbine engine is provided comprising a housing having a cylindrical first swirl chamber; a cylindrical exit chamber, concentric with the first swirl chamber and with an internal diameter smaller than the internal diameter of the first swirl chamber, the exit chamber having a terminal end positioned to directly communicate with a combustion chamber of the gas turbine engine, and a convergent chamber section joining the first swirl chamber and the exit chamber. A fuel entrance port is provided in the housing, inclined relative to the internal wall of the first swirl chamber, for impinging fuel directly onto the internal wall of the first swirl chamber. At least one air inlet hole is formed in the wall of the first swirl chamber, downstream of the impinging fuel, for directing the air passing therethrough to flow in a single circumferential direction around the internal wall of the first swirl chamber to cause the fuel to lie in a film on the inner wall of the first swirl chamber and move along the wall in the same direction as the air flow therein. The fuel nozzle further includes an annular second swirl chamber, formed about the outer periphery of the exit chamber, having an inwardly converging conical cap portion for directing air flowing through the second swirl chamber into close association with the fuel film exiting from the exit chamber and therefrom into the combustion chamber.

Preferably, the dimensions of the air inlet hole and the fuel entrance port are selected such that the mass flow of air through the air inlet hole is between 0.25 and 2 times the mass flow of fuel for predetermined pressure differentials across the air inlet hole and the fuel entrance port.

In accordance with the purposes of the invention there is further disclosed a method for providing fine fuel droplet sizes in the fuel spray from a turbine engine fuel nozzle assembly at relatively low fuel flow rates through the nozzle and relatively low pressure differentials across the nozzle. The method comprises the steps of: impinging the fuel directly onto an internal wall surface of a first cylindrical swirl chamber of the nozzle assembly, and introducing air into the first swirl chamber, downstream of the impinging fuel, in a substantially tangential flow path around the internal wall surface of the first swirl chamber to cause the fuel to lie on the internal wall surface in a substantially smooth film and swirl circumferentially about the first swirl chamber in substantially the same direction as the air flow therein. The tangential velocity of the swirling air and fuel film is then increased. Next, air swirling in a second annular swirl chamber formed about the periphery of the exit chamber is directed into close association with the air and fuel film exiting from the exit chamber to thereby break-up the swirling fuel film into a fuel spray having fine droplets and a predetermined spray angle.

Preferably, the tangential velocity of the swirling air and fuel film is increased by causing the air and fuel film in the first swirl chamber to move into an exit chamber having a smaller diameter than the first swirl chamber.

In accordance with the purposes of the invention there is also provided a system for controlling the spray angle from a gas turbine engine fuel nozzle comprising a fuel nozzle housing having first and second concentric passages and a flange portion having a fuel entrance port inclined relative to an internal wall surface of the first concentric passage for impinging fuel directly onto the internal wall surface of the first concentric passage. First and second air inlet means are provided for introducing air, respectively, into the first and second concentric passages in a substantially tangential path relative to the internal wall surface of each passage. An air source means for providing air to the fuel nozzle, and air conduit means for connecting the air source means to the first and second air inlet means are included in the system. A control means for controlling the volumetric air flow rate from the air source means to the first and second air inlet means is provided to thereby control the axial and tangential momentums of the air flow in the first and second concentric passages to selectively adjust the spray angle from the nozzle.

BRIEF DESCRIPTION OF THE DRAWINGS

The accompanying drawings, which are incorporated in and constitute a part of the specification, illustrate a preferred embodiment of the invention and, together with the general description given above and the detailed description of the preferred embodiment given below, serve to explain the principles of the invention.

DESCRIPTION OF THE PREFERRED EMBODIMENT

Reference will now be made in detail to the present preferred embodiment of the invention as illustrated in the accompanying drawings.

In accordance with the present invention, there is provided a fuel nozzle for a gas turbine engine including a housing with a cylindrical first swirl chamber and a cylindrical exit chamber, concentric with the first swirl chamber and having an internal diameter smaller than the internal diameter of the first swirl chamber. The exit chamber has a terminal end positioned to directly communicate with a combustion chamber of the gas turbine engine.

Figure 1:
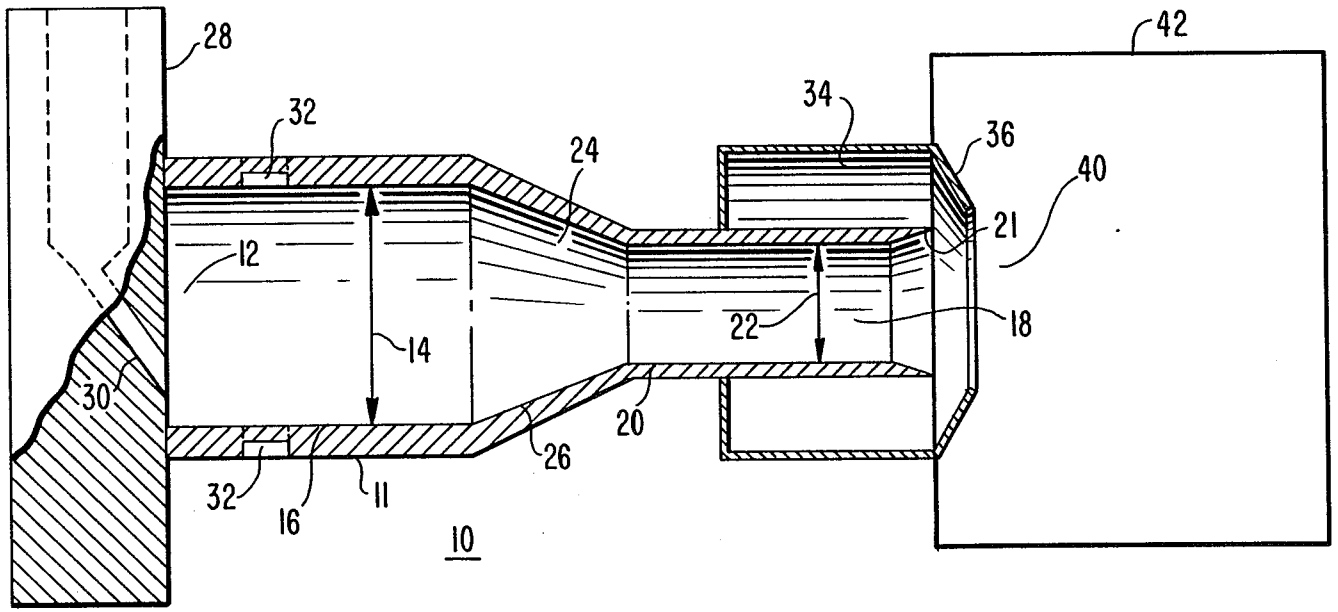
FIG. 1 is a plan view of an air-blast type fuel nozzle incorporating the teachings of the present invention.

As embodied herein and illustrated in FIG. 1, the fuel nozzle is broadly designated by reference numeral 10. The fuel nozzle comprises a housing 11 with cylindrical first swirl chamber 12 formed therein and having an internal diameter 14 and an internal wall surface 16. Preferably, the axial length of first swirl chamber 12 is at least twice the internal diameter 14. Housing 11 is further provided with a cylindrical exit chamber 18, concentric with the first swirl chamber 12, and having an internal wall surface 20, a terminal end 21, and an internal diameter 22 which is selected to be smaller than the internal diameter 14 of the first cylindrical swirl chamber 12. Terminal end 21 communicates directly with a combustion chamber 42 of a gas turbine engine (not shown).

In accordance with the present invention, the fuel nozzle further includes a convergent chamber joining the first swirl chamber and the exit chamber and a fuel entrance port, inclined relative to the internal wall of the first swirl chamber, for impinging fuel directly onto the internal wall of the first swirl chamber. As embodied herein, a convergent section 24, having an internal wall surface 26, joins the first swirl chamber 12 and exit chamber 18. A mounting flange 28 is provided on the upstream end of first swirl chamber 12. Mounting flange 28 has a fuel entrance port 30 which is inclined relative to the internal wall 16 of first swirl chamber 12. Fuel exiting the fuel entrance port 30 impinges directly onto the internal wall 16 of the first swirl chamber 12.

Figure 2:
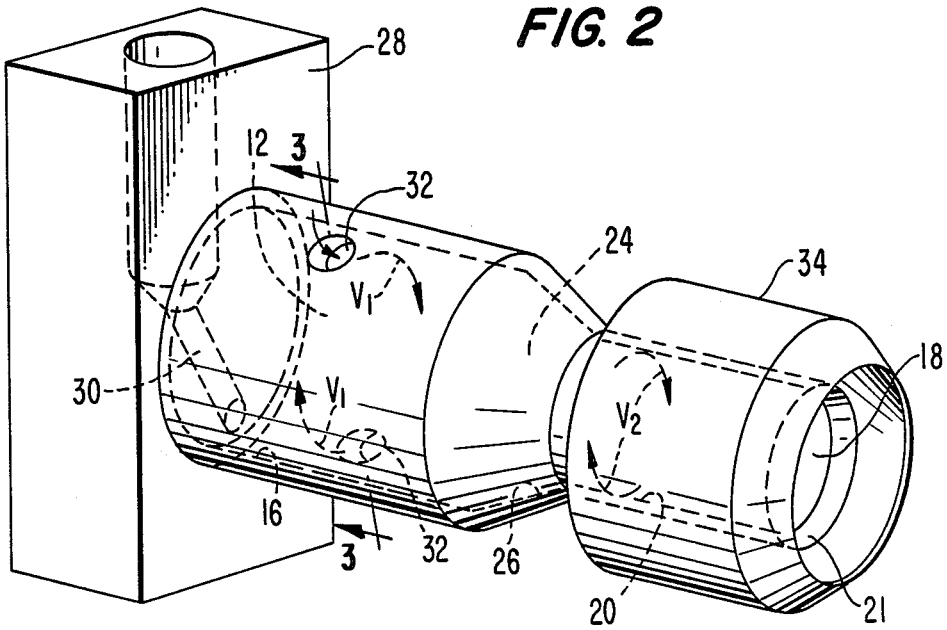
FIG. 2 is an isometric view of the nozzle illustrated in FIG. 1 showing the relative directions of air and fuel flow in the nozzle.

In accordance with the invention, at least one air inlet hole is formed in the wall of the first swirl chamber, downstream of the impinging fuel, for directing the air passing therethrough to flow in a single circumferential direction around the internal wall of the first swirl chamber to cause the fuel to lie in a film on the inner wall of the first swirl chamber and move along the wall in the same direction as the air flow therein. As embodied herein, air inlet holes 32 are formed in the wall of first swirl chamber 12 downstream of the impinging fuel from fuel inlet port 30. Air passing through air inlet holes 32 is directed by the configuration of the inlet holes 32 to flow in a single circumferential direction around the internal wall of first swirl chamber 12 thereby causing the fuel to lie in a film on the inner wall 16 of first swirl chamber 12 and to move along the wall in the same circumferential direction as the air flow. With reference to FIG. 2, preferably, the fuel entrance port 30 is inclined relative to the internal wall 16 such that fuel impinging on the wall is moving in the same circumferential direction in swirl chamber 12 as the air entering through air holes 32.

Figure 3:
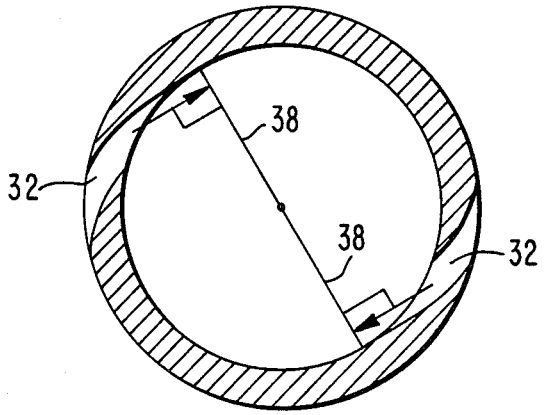
FIG. 3 is a cross-sectional view of the nozzle illustrated in FIG. 1 taken along the lines 3—3 showing the configuration of one embodiment of the air inlet hole.

By way of example and not limitation, as shown in FIG. 3, air holes 32 are configured to terminate substantially tangential to internal wall 16 to direct air flowing therethrough circumferentially along internal wall 16.

The air is caused to flow through air inlet holes 32 into first swirl chamber 12 by a pressure differential across the inlet hole. The pressure differential across air inlet holes 32 may be caused by the normal pressure drop across the combustion chamber liner caused by axial fuel flow therethrough, by pressure supplied by an external air pump or other source of pressurized air, or by any other means which creates a higher pressure outside of the swirl chamber 12 than inside the chamber. Fuel flows through fuel entrance port 30 into first swirl chamber 12 due to a pressure differential across fuel entrance port 30 caused by higher pressures upstream in the fuel flow path than inside first swirl chamber 12.

In accordance with the invention there is further provided an annular second swirl chamber, formed about the outer periphery of the exit chamber, having an inwardly converging conical cap portion for directing air flowing through the second swirl chamber into close association with the fuel film exiting from the exit chamber. As embodied herein annular second swirl chamber 34 is formed about the outer periphery of the exit chamber 18. Annular second swirl chamber 34 includes a inwardly converging conical cap portion 36 for directing air exiting second swirl chamber 34 into close association with the fuel and air exiting from exit chamber 18, thus creating an intense shearing effect on the slower-moving fuel which breaks up the fuel film into exceptionally fine droplets. The air exiting from second swirl chamber 34, and the air and fuel exiting from exit chamber 20 passes directly into combustion chamber 42.

In operation, the fuel in first swirl chamber 12 acquires some of the kinetic energy of the air flowing through the air inlet holes 32 and thereby causes the fuel to lie in a relatively smooth film on internal wall surface 16 of first swirl chamber 12. The fuel thus begins to move along internal wall surface 16 in the same circumferential direction as the air. As the fuel film moves axially along the internal wall surface 16 it enters convergent section 24 while adhering to internal wall surface 26 of convergent section 24. The reduced internal diameter of convergent section 24, relative to internal diameter 14 of first swirl chamber 12, causes the tangential velocity of the fuel film in convergent section 24 to increase in accordance with the law of conservation of angular momentum. As the fuel film moves axially through convergent section 24 it enters exit chamber 18 and begins to swirl about internal wall surface 20. The tangential velocity of the fuel film increases from velocity $V_1$ in first swirl chamber 12, to velocity $V_2$ in the exit chamber, as illustrated in FIG. 2. Velocity $V_2$ is related to velocity $V_1$ in the same proportion as internal diameter 14 is related to internal diameter 22. Thus, the fuel film has a tangential velocity $V_2$ in exit chamber 18 that is higher than would be created in a fuel nozzle having a constant internal diameter. In this manner, at relatively low fuel flow rates through the nozzle, the fuel is in-part broken-up into fine droplets by utilizing the kinetic energy of the swirling fuel and air. Thus the instant invention provides a finer fuel spray at low fuel flow rates than is available from prior art air-blast type nozzles.

In the preferred embodiment of the invention illustrated in FIGS. 1 and 3, the air inlet holes 32 have an internal surface having a portion thereof which terminates substantially tangential to the internal wall 16 of the first swirl chamber 12 such that air enters first swirl chamber 12 substantially perpendicular to a radius 38 of the first swirl chamber.

The length and cross-sectional dimensions of air inlet holes 32 and fuel entrance port 30 are preferably selected such that the mass flow of air is between about 0.25 and 2 times the mass flow of fuel for predetermined pressure differentials across air inlet holes 32 and fuel entrance port 30. Given the desired ratio of mass flow of air to mass flow of fuel, and knowing the viscosity of the air and fuel and the pressure differential across the inlet holes and the fuel entrance port, one skilled in the art can determine the necessary lengths and cross-sectional areas of the air inlet holes 32 and fuel entrance port 30.

Second swirl chamber 34, located about the periphery of exit chamber 18, is preferably configured to swirl air flowing therein in the same circumferential direction as the air flow in first swirl chamber 12. However, second swirl chamber 34 may be configured to swirl air in the opposite circumferential direction as the air flow in first swirl chamber 12 while still achieving the objects of the instant invention.

The intense shearing effect produced on the fuel film, as it leaves the exit chamber, by the air flow from second swirl chamber 34 effectively breaks up the fuel film into fine droplets even at low fuel flows. This shearing effect is enhanced due to the increased tangential velocity of the fuel film caused by the difference in internal diameters between the first swirl chamber and the exit chamber.

With continued reference to FIG. 1, fuel nozzle 10 is configured with only two concentric passages. The first concentric passage comprises first swirl chamber 12, convergent chamber 24, and exit chamber 18. The second concentric passage comprises second swirl chamber 34. This two passage configuration for fuel nozzle 10 is less complex and hence less costly to manufacture than prior art air-blast type fuel nozzles which comprise three concentric passages.

Figure 4:
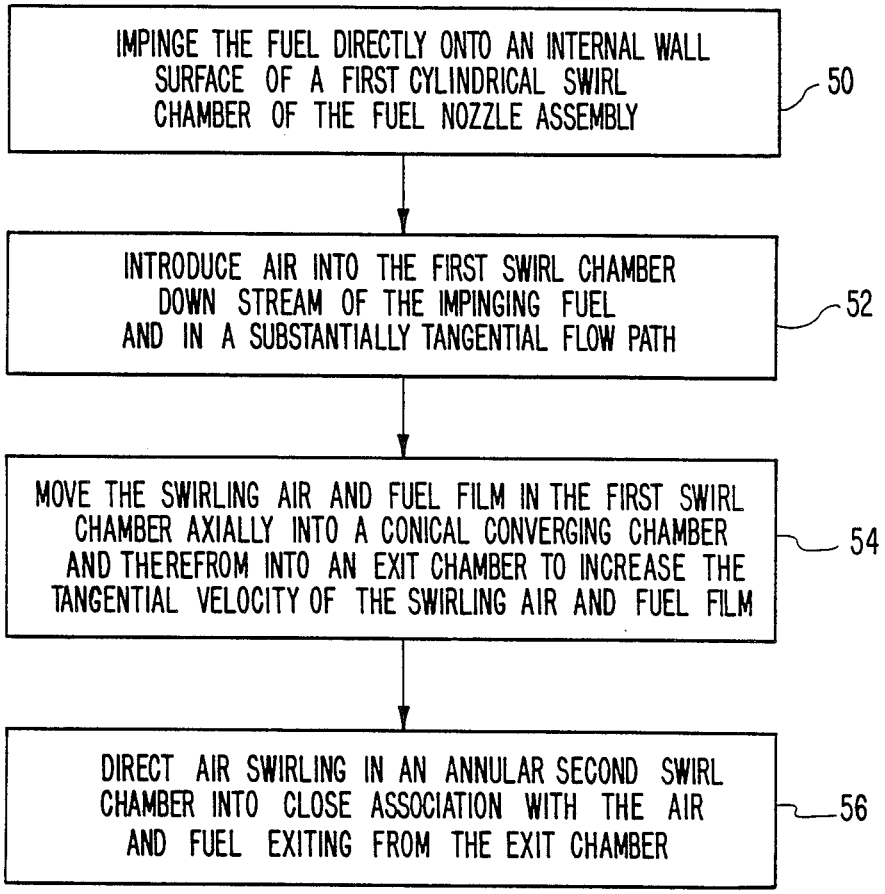
FIG. 4 is a flow chart illustrating the steps of the method of the present invention for providing fine fuel droplets at relatively low fuel flows.

In accordance with the instant invention, and as illustrated in FIG. 4, there is disclosed a method for providing fine fuel droplet sizes in the fuel spray from a turbine engine fuel nozzle assembly at relatively low fuel flow rates through the nozzle and relatively low pressure differentials across the nozzle. At step 50 the fuel is impinged directly onto an internal wall surface of a first cylindrical swirl chamber of the nozzle assembly. At step 52 air is introduced into the first swirl chamber, downstream of the impinging fuel, in a substantially tangential flow path around the internal wall surface of the first swirl chamber to cause the fuel to lie on the internal wall surface of the first swirl chamber in a substantially smooth film and swirl circumferentially about the first swirl chamber in substantially the same direction as the air flow therein. At step 54 the tangential velocity of the swirling air and fuel film is increased. By way of example and not limitation, the tangential velocity is increased by moving the swirling air and fuel film into an exit chamber having a smaller diameter than the first swirl chamber to thereby increase the tangential momentum of the air and fuel film in accordance with the law of conservation of angular momentum. The swirling air and fuel film is caused to move into the exit chamber by providing a single exit for the air and fuel from the exit chamber and the first swirl chamber.

At step 56, air swirling in a second annular swirl chamber formed about the periphery of the exit chamber, is directed into close association with the air and fuel film exiting from the exit chamber to thereby break-up the swirling fuel film into a fuel spray having fine droplets and a predetermined spray angle. The method of the instant invention provides the advantage over prior art methods of injecting fuel into a gas turbine engine of utilizing the kinetic energy associated with the swirling air and fuel to break-up the fuel into fine particle sizes at relatively low fuel flow rates. Prior art methods used the pressure drop across the fuel nozzle to atomize the fuel and thus suffered the disadvantage of having increased fuel drop sizes when the fuel flow was relatively low, and the corresponding pressure drop relatively low, during start-up of the engine. The method of the instant invention alleviates this inherent disadvantage of prior art methods of injecting fuel into an engine.

Preferably, at step 52 the air is introduced into the first swirl chamber through at least one air inlet hole configured in the wall of the first swirl chamber. The method of the instant invention provides the additional advantage of being able to adjust the spray angle of the fuel leaving the exit chamber by controlling the volumetric air flow rate in the first swirl chamber and in the second swirl chamber to thus adjust the axial and tangential momentums of the swirling air and fuel. By way of example and not limitation, the volumetric air flow rates may be controlled by adjusting the pressure differential across the walls of the first and second swirl chambers.

In accordance with the instant invention, there is also provided a system for selectively adjusting the fuel spray angle from a gas turbine engine fuel nozzle which includes a fuel nozzle housing having first and second concentric passages, and a flange portion having a fuel entrance port inclined relative to an internal wall surface of the first concentric passage for impinging fuel directly onto the internal wall surface. As embodied herein, and illustrated in FIG. 5, fuel nozzle housing 58 includes a first concentric passage 60 and a second concentric passage 62 formed as an annulus about an exit section 68 of first concentric passage 60. Annular second concentric passage 62 is configured with a conical cap portion 63 for directing air exiting from second concentric passage 62 in a predetermined inclination with respect to the nozzle. First concentric passage 60 further includes cylindrical chamber 64 and converging chamber 66. A flange portion 72 having a fuel entrance port 74 is configured at the upstream end of cylindrical chamber 64. Fuel enters the fuel nozzle through entrance port 74 due to the inclination of the entrance port relative to the internal wall 76.

In accordance with the invention, there is further provided first and second air inlet means for introducing air, respectively, into the first and second concentric passages in a substantially tangential path relative to the internal wall of each said passage. As embodied herein, the first and second air inlet means comprise air inlet holes 78 and 80, respectively. Air inlet hole 78 is formed in the wall of cylindrical chamber 64 and is configured such that air moving through the hole exits into cylindrical chamber 60 substantially tangential to internal wall 76. Air inlet hole 80 is similarly configured in external wall 70 of second concentric passage 62. The first and second air inlet means is not limited to single air inlet holes 78 and 80 and may comprise a plurality of air inlet holes configured in external walls 64 and 70.

Figure 5:
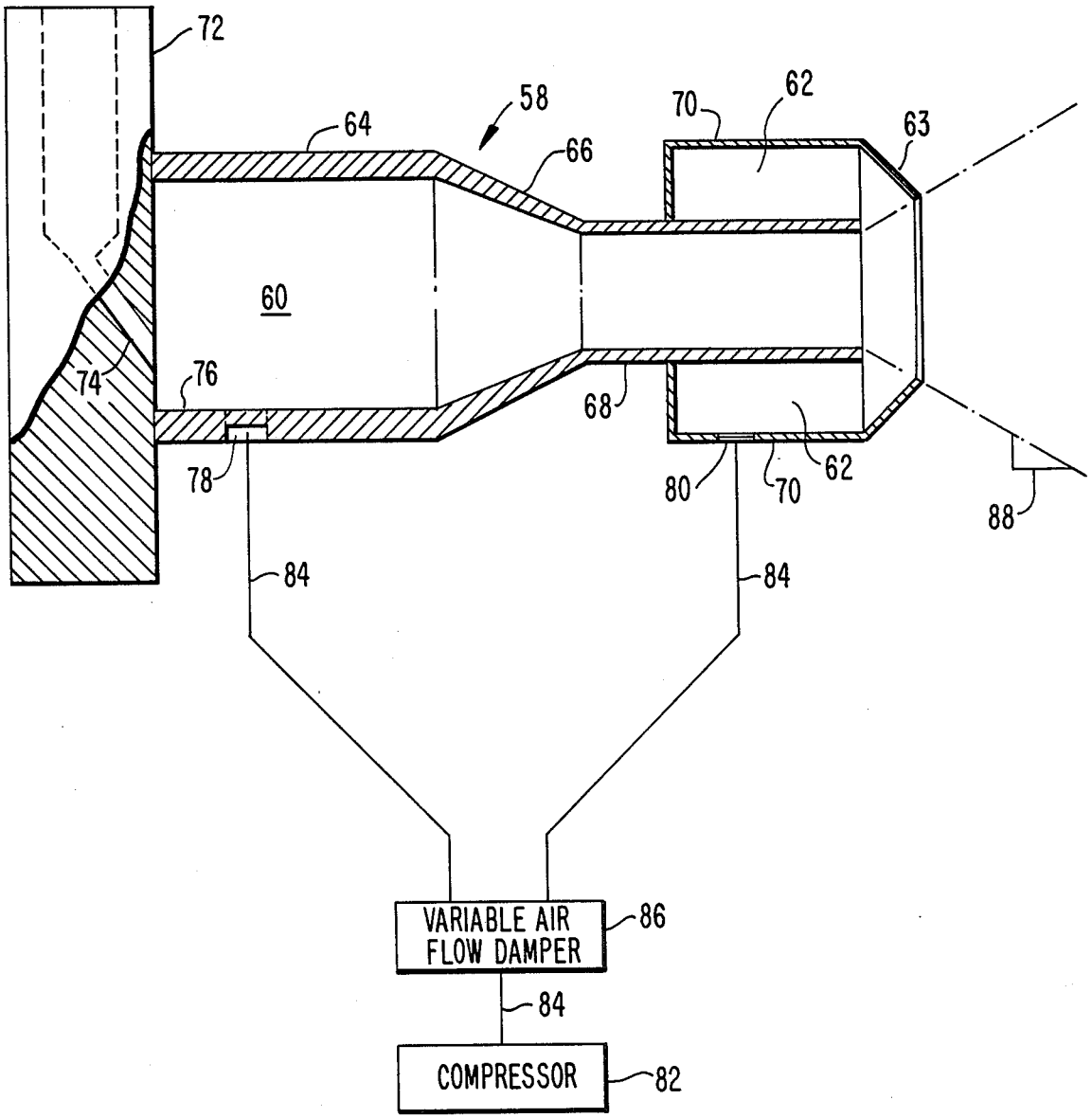
FIG. 5 is a schematic illustration of the system in accordance with the present invention for adjusting the fuel spray angle from a fuel nozzle.

With continued reference to FIG. 5, there is further provided an air source means for providing air to the fuel nozzle. As embodied herein, the air source means comprises a compressor 82, shown schematically in FIG. 5. The means for providing air to the fuel nozzle is not limited to compressor 82 and may comprise a fan or any type of device that is capable of creating a higher pressure upstream of the air inlet holes so as to urge air through the air inlet holes into the concentric passages.

An air conduit means for connecting the air source means to the air inlet means is also provided. As embodied herein, the air conduit means comprises air ducts 84, also shown schematically in FIG. 5, which interconnect compressor 82 and inlet holes 78 and 80. The air conduit means is not limited to ducts 84 and may comprise a plenum or plenums configured about first concentric passage 60 and second concentric passage 62. In such a plenum configuration, a higher pressure is created inside the plenum than is felt inside respective concentric passages to thereby urge air to flow through air inlet holes 78 and 80.

Control means for controlling the volumetric air flow rate from the compressor 82 through ducts 84 to inlet holes 78 and 80 is also provided. As embodied herein, the control means comprises a variable air flow damper 86 positioned in the duct 84 between the compressor 82 and inlet holes 78 and 80. By controlling the volumetric air flow rate through inlet holes 78 and 80 the axial and tangential momentums of the air flow in first concentric passage 60 and second concentric passage 62 may be controlled to selectively adjust the spray angle 88 of fuel exiting from exit chamber 68. Thus, the system of the instant invention is capable of adjusting the spray angle of fuel exiting from the nozzle by controlling the tangential and axial momentums of the swirling air and film. It should be understood that the system of the instant invention can be utilized with nozzles having more than two concentric passages by controlling the axial and tangential momentums of fuel or air in one or more of the concentric passages.

Additional advantages and modifications will readily occur to those skilled in the art. The invention in its broader aspects is, therefore, not limited to the specific details, representative apparatus and illustrative example shown and described. Accordingly, departures may be made from such details without departing from the spirit or scope of the general inventive concept as defined by the appended claims and their equivalents.

What is claimed is:

1. A fuel nozzle for a gas turbine engine comprising:

a nozzle housing;

a cylindrical first swirl chamber in said housing, said first swirl chamber having an internal wall with an internal diameter;

a cylindrical exit chamber in said housing, concentric with said first swirl chamber, having an internal diameter smaller then the internal diameter of said first swirl chamber, said exit chamber having an outer periphery and a terminal end positioned to directly communicate with a combustion chamber of said gas turbine engine;

a convergent chamber in said housing joining said first swirl chamber and said exit chamber;

a fuel entrance port in said housing, inclined relative to the internal wall of the first swirl chamber, for impinging fuel directly onto the internal wall of said first swirl chamber;

at least one air inlet hole formed in the internal wall of said first swirl chamber, downstream of said impinging fuel, said chamber including means for swirling and directing the air passing therethrough to flow in a single circumferential direction around the internal wall of said first swirl chamber to cause the fuel to lie in a film on the inner wall of said first swirl chamber and move along the wall in the same direction as said air flow; and an annular second swirl chamber including an air inlet and means for swirling air, said annular second swirl chamber, formed about the outer periphery of said exit chamber, having an inwardly converging conical cap portion for directing air flowing through said second swirl chamber into close association with the fuel film exiting from said exit chamber and therefrom into said combustion chamber.

2. The fuel nozzle of claim 1, wherein said inlet air hole has an internal surface having a portion thereof which terminates substantially tangential to the internal wall of said first cylindrical swirl chamber such that air flowing therethrough enters said first swirl chamber substantially perpendicular to a radius of said first cylindrical swirl chamber.

3. The fuel nozzle of claim 1, wherein said fuel entrance part is inclined relative to the internal wall of said first swirl chamber to impinge fuel flowing therethrough against the internal wall in the same circumferential direction as said air flow.

4. The fuel nozzle of claim 1, wherein the axial length of said first swirl chamber is at least twice the internal diameter of said first swirl chamber.

5. The fuel nozzle of claim 1, wherein the dimensions of said air inlet hole and said fuel entrance port are selected such that the mass flow of air through said air inlet hole is between about 0.25 and 2 times the mass flow of fuel for predetermined pressure differentials across said air inlet hole and said fuel entrance port.

6. The fuel nozzle of claim 1, wherein said means for swirling air in said annular second swirl chamber swirls air in the same circumferential direction as said air flow in said first swirl chamber.

7. The fuel nozzle of claim 1, wherein said means for swirling air in said annular second swirl chamber swirls air in the same circumferential direction as said air flow in said first swirl chamber.

8. A method for providing fine fuel droplet sizes in the fuel spray from a turbine engine fuel nozzle assembly at relatively low fuel flow rates through the nozzle and at relatively low pressure differentials across the nozzle, the method comprising the steps of:

impinging the fuel directly onto an internal wall surface of a first cylindrical swirl chamber of the nozzle assembly;

introducing air into the first swirl chamber, downstream of the impinging fuel, in a substantially tangential flow path around the internal wall surface of the first swirl chamber to cause said fuel to lie on said internal wall surface in a substantially smooth film and swirl circumferentially about the first swirl chamber in substantially the same direction as the air flow therein;

increasing the tangential velocity of the swirling air and fuel film in an exit chamber operatively connected to the first swirl chamber;

directing air swirling in a second swirl chamber into close association with the increased tangential velocity swirling air and fuel film exiting the exit chamber to thereby break-up said swirling fuel film into a fuel spray having fine droplets and a predetermined spray angle.

9. The method of claim 8, wherein said step of increasing the tangential velocity is accomplished by causing the swirling air and fuel film in the first swirl chamber to move into and swirl about an axit chamber having a small diameter than the first swirl chamber.

10. The method of claim 8 including the further step of selectively adjusting the predetermined spray angle of said fuel spray by controlling the volumetric air flow into said first and second swirl chambers to thereby control the axial and tangential momentums of said swirling air in said exit chamber and said second swirl chamber.

* * * * *